United States Patent [19]

Hanafi

[11] Patent Number: 4,566,370

[45] Date of Patent: Jan. 28, 1986

[54] PISTON PUMP ARRANGEMENT

[75] Inventor: Nabil Hanafi, Urach, Fed. Rep. of Germany

[73] Assignee: Uraca Pumpenfabrik GmbH & Co. KG, Uraca, Fed. Rep. of Germany

[21] Appl. No.: 571,486

[22] Filed: Jan. 17, 1984

[30] Foreign Application Priority Data

Jan. 18, 1983 [DE] Fed. Rep. of Germany ..... 3301380

[51] Int. Cl.[4] ..... F04B 21/00

[52] U.S. Cl. ..... 92/59; 92/73; 92/128; 92/147; 92/153; 417/415; 417/239; 248/558; 74/44

[58] Field of Search ..... 92/59, 128, 73, 147, 92/153; 417/415, 238, 239, 63; 123/DIG. 7, 195 HC; 418/39; 74/44; 415/DIG. 3; 248/558, 916; 310/42

[56] References Cited

U.S. PATENT DOCUMENTS

| | | | |
|---|---|---|---|
| 1,321,923 | 11/1919 | Knox | 92/59 |
| 1,445,889 | 2/1923 | Hunter | 92/128 |
| 1,556,859 | 10/1925 | L'Orange | 92/59 |
| 2,469,936 | 5/1949 | Tabbert | 418/39 |
| 2,665,636 | 1/1954 | Lauck et al. | 418/39 |
| 2,856,859 | 10/1958 | Baade et al. | 418/39 |
| 3,698,288 | 10/1972 | Sonobe | 417/415 |
| 3,760,694 | 9/1973 | Lieb | 92/73 |
| 4,050,862 | 9/1977 | Buse | 92/128 |
| 4,133,508 | 1/1979 | Sloyan | 248/558 |
| 4,441,684 | 4/1984 | Credle, Jr. | 248/300 |

FOREIGN PATENT DOCUMENTS

| | | | |
|---|---|---|---|
| 460554 | 10/1949 | Canada | 417/238 |

*Primary Examiner*—Robert E. Garrett
*Assistant Examiner*—Richard S. Meyer
*Attorney, Agent, or Firm*—Barnes & Thornburg

[57] ABSTRACT

A piston pump arrangement is provided which includes a drivable crank shaft supported in a crank drive housing for rotational movement. The crank shaft is drivingly connected to horizontally disposed axially reciprocating pump pistons. In order to facilitate driving of the crank shaft from either the right side or the left side to accommodate the available space requirements and driving motor connections, the crank drive housing is provided with fastening support surfaces arranged symmetrically with respect to a plane through the axis of the crank shaft and the axes of the pump pistons. To accommodate attachment of auxiliary aggregates, such as lubricating/cooling circuit mechanisms, fastening points for such aggregates are also arranged symmetrically with respect to the plane of the crank shaft axis and the pump pistons.

17 Claims, 6 Drawing Figures

V
VI
M
M₁
M₂

PISTON PUMP ARRANGEMENT

BACKGROUND AND SUMMARY OF THE INVENTION

The invention relates to a piston pump arrangement with horizontally arranged pistons, plungers, or the like driven by a crank drive mechanism mounted in a crank drive housing. The crank drive housing is supportable at respective support surfaces at an installation in use position by means of a plurality of supports. The piston shafts are connected with the rotatable crank drive shaft so as to be axially horizontally reciprocable in response to rotation of the crank drive shaft. The crank drive shaft includes a connecting drive at on end of the shaft extending out of the crank drive housing for attachment to a driving motor or the like.

In piston pump arrangements of this kind, the available space for the pump arrangement and the mechanism drivingly connected to the crank drive shaft dictate whether the pump should be driven from the right hand or the left hand end of the crank drive housing as viewed in a direction along the axe of the pump pistons. Likewise, the operation site will dictate whether the crank drive housing is disposed at the right or left side of the pump.

For the foregoing reasons, the crank shaft for such piston pump arrangements must be assembled at different fitting positions in dependence on whether the crank drive shaft is to be driven from the right or left to accomodate respective end use locations, a requirement which necessarily increases the cost for such pump constructions.

It is true that corresponding problems do not exist with piston pumps of this general type with vertically oriented pistons, because such pumps exhibit approximately the same space requirements at both sides of the vertical middle plane through the axis of the crank drive shaft so that the same pump can without change in the fitting position of the crank shaft be used for both right and left sided drive. However, such pumps have a large vertical space requirement which can often prohibit their use. In addition there are static and vibration technical disadvantages with this type of vertical piston pump and furthermore the connection of the suction and or pressure lines must be arranged relatively high.

Therefore it is an object of the present invention to create a piston pump arrangement of the above-mentioned general type with horizontally disposed pistons, wherein the crank drive mechanism can be substantially preassembled at the factory without concern for the in-use location and driving direction of the crank shaft. The invention proposes solving the above-mentioned problems by providing a crank drive mechanism which has support or holding surfaces for connecting the same into an in-use position, which support surfaces are disposed symmetrically with respect to a plane containing the crank drive shaft rotational axis as well a the reciprocating axes of the pump pistons driven by the crank drive shaft. In preferred embodiments, the crank drive housing is provided also as necessary with fastening receptacles or the like approximately symmetrically with respect to this horizontal plane for accomodating detachable attachment of auxiliary parts.

With the crank drive housing constructed in the above-mentioned manner according to the invention, the same can be inverted to change the driving end of the crank shaft without changing the vertical disposition of the crank drive shaft. Accordingly, the bearing support of the crank shaft in the crank drive housing can be designed and built into the manufacture of the pump arrangement at the factory without regard to the direction from which the crank drive shaft will be driven in its in-use position. The respective desired driving side can be accomodated during the final assembly of the pump arrangement which occurs at the location where the pump is to be used. The end assembly must take into account the proper alignment and connection of the required subassemblies at the crank drive mechanism, in dependence on the driving side of the crank drive shaft. Because of the symmetrical arrangement of the fastening points at the crank housing with respect to the plane through the crank shaft axis and the pump piston axes, this final assembly can be easily accomplished.

With sufficient symmetrical configuration of the crank drive housing and mechanism according to the invention, it is possible to dispose the unit for either driving direction without incurring vibration problems.

In accordance with an advantageous embodiment of the invention, the end of the crank drive housing opposite of the driving connection for the crank drive shaft has a lubricating oil pump and/or cooling medium pump for circulating of cooling/lubricating medium to the crank drive mechanism and/or further pump parts such as the piston pump parts being driven by the crank drive shaft.

In especially preferred embodiments, a support cover is arranged at an end face of the crank drive shaft to support the lubricating/cooling pump aggregate in a position in driving connection to the crank drive shaft. The support cover is fastened at a housing flange by means of connecting parts such as threaded bores and bolts disposed symmetrically with respect to the horizontal plane through the crank drive shaft and the pump pistons.

According to a preferred embodiment of the invention, the driving connection between the lubricating-/cooling medium pump aggregate and the crank drive shaft is by way of a toothed ring at the end face of the crank shaft engageable with a driving pinion of the pump aggregate.

According to other preferred embodiments, the lubricating/cooling pump aggregate can be disposed and driven separately from the crank drive shaft for the horizontal pump pistons.

In preferred embodiments which have a cooler device for cooling the lubricating/cooling medium in the circuit of the lubricating/cooling aggregate, the connection lines between the cooler, the crank drive housing, and the lubricating/cooling medium pump are formed as exchangeable, similar, flexible hoses. This arrangement makes it readily possible to accomodate changes in the position of the crank drive housing by changing the connecting positions of the hoses at respective fittings disposed symmetrically with respect to the horizontal plane of the crank drive shaft axis and the pump piston reciprocating axes.

Further objects, features, and advantages of the present invention will become more apparent from the following description when taken with the accompanying drawings which show, for purposes of illustration only, an embodiment in accordance with the present invention.

DETAILED DESCRIPTION OF THE DRAWINGS

Figure 1:
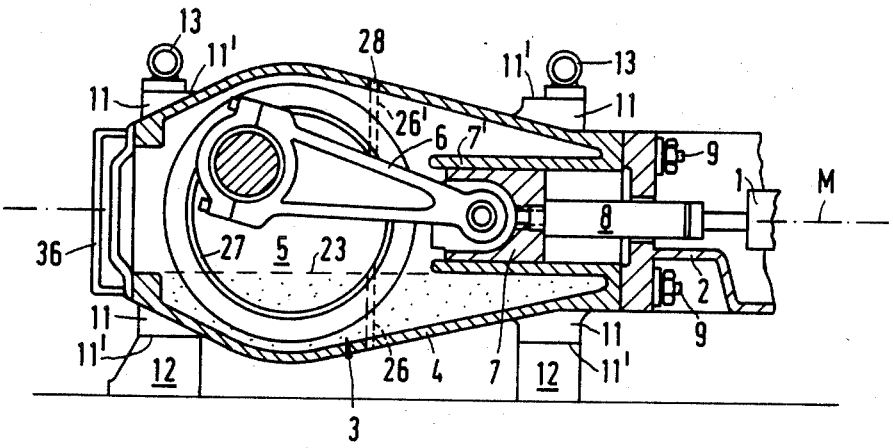
FIG. 1 is a schematic sectional view in the direction of the axis of the crank drive shaft of a piston pump arrangement constructed in accordance with a preferred embodiment of the present invention.

The piston pump arrangement of the invention includes horizontally disposed pistons 1 (only schematically depicted in FIG. 1) which are disposed in piston housing 2 and driven by means of a crank drive mechanism depicted generally by reference character 3. The pump pistons 1 are drivingly connected in a manner known per se by means of crosshead 7 with transfer rods 8 and connecting rods 6 to the rotatably driven crank shaft 5 arranged in the crank shaft housing 4. The connection between the connecting or transfer rods 8 and the pistons 1 is such as to assure a certain lateral and angular movability so as to avoid that any distortion or twisting forces are introduced because of manufacturing or assembly tolerances that could otherwise result in the misalignment of the pistons 1, crosshead assembly 7 and transfer rods 8. In such an arrangement it is possible without manufacturing tolerance problems to detachably connect the piston housing 2 by means of screw threaded bolts 9 or the like with the crank drive housing 4. Such a construction with detachable subassemblies is especially preferred. However, embodiments are contemplated wherein the piston housing 2 is formed as an integral part with the crank housing 4, in which case the above mentioned lateral and angular movement can be generally avoided during the manufacture.

The crank shaft 5 is simply drivable from one end face by means of a not illustrated driving motor or other driving machine and for this purpose crank shaft 5 is provided with a coupling part 5' accessible from outside of the crank housing 4, preferably a toothed trunnion.

At the end of the crank shaft 5 opposite the coupling part 5', a lubricating oil pump aggregate 10 is drivingly connected as further explained below.

In order to facilitate that the crank drive mechanism 3 can be selectively driven from the right side or from the left side—as viewed from shaft 5 toward the pistons 1—without requiring different fitting connection of the crank shaft 5 at the crank drive mechnism 3 during the factory assembly, pedestals 11 with fastening surfaces 11' are arranged at the crank drive housing 4 disposed symmetrically about plane M which includes the axle of the crank shaft 5 as well as the reciprocating movement axes of the crosshead means 7 and the respective pistons 1. The fastening surfaces 11' serve as required for the arrangement of bearing support anchoring feet 12 and bearing rings or eyelets 13 whereby the crank housing 4 can be selectively disposed to be driven from the right side (FIGS. 3 and 5) or inverted to the position for driving from the left side (FIGS. 4 and 6) without any resultant change in the distance between the crank shaft 5 and the connecting points for the housing 4. The eylets 13 are detachably engageable with the respective upwardly facing support surfaces 11' for accomodating lifting of the housing during the transport or during assembly.

Preferably the crank drive mechanism 3 is formed approximately symmetrically to the plane M so that the symmetrical disposition of the supports and the formation of the guides 7' for the crossheads means 7 in the crank housing 4 accomodates the location of the assembly for both driving directions of the crank shaft 5 without limitation.

In so far as auxiliary subassemblies or aggregates must be arranged at the crank drive housing 4 non-symmetrically to the plane M, the corresponding connecting points for same are arranged symmetrically to the plane M so that these sub-assemblies can be arranged in a proper orientation independently of the respective right hand or left hand drive position of the crank drive housing 4. Compare the arrangement depicted in FIG. 1 for the detachable piston housing 2 connected by means of threaded bolts 9 and corresponding openings in housing 4, arranged symmetrically to plane M.

Figure 2:
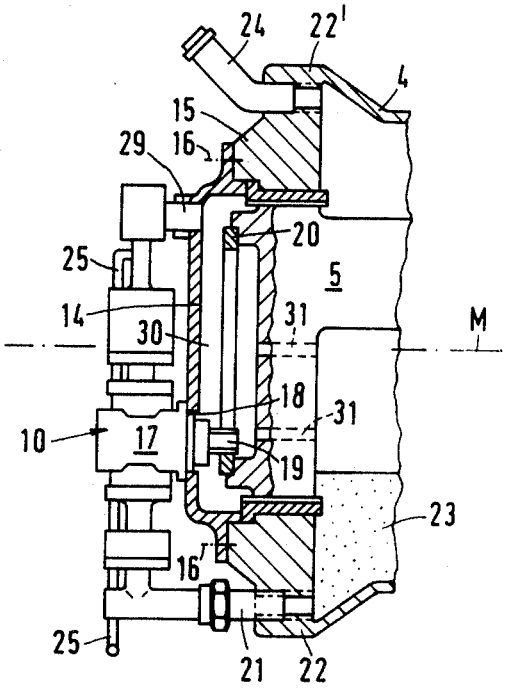
FIG. 2 is a partial sectional side view of the arrangement of FIG. 1, taken in the direction transverse to the crank drive shaft axis in the region of a lubricating oil pump assembly at one end of the crank drive housing.

The symmetrical orientation of the fastening points for the lubricating oil pump aggregate 10 is especially advantageous according to the invention. This aggregate 10 is connected at a housing flange 15 by means of a support cover 14 which covers an opening of the crank housing 4 in the region of the adjacent end face of the crank shaft 5. Fastening screws 16, shown only schematically, are distributed symmetrically with respect to the middle plane M so that the lubricating oil pump aggregate 10 can be assembled in a position as depicted in FIG. 2 for either of the use positions of the crank drive housing 4.

The lubricating oil pump aggregate 10 is assembled at an opening 18 of the support cover 14 with the pump part 17 in such a way that a driving pinion 19 of the pump part engages with a toothed ring 20 carried at the end face of the crank shaft 5 in a ring shaped stepped recess.

The suction side of the pump part 17 is connected with a pipe fitting 21 threaded into a bulge 22 of the crank drive housing 4. The bulge 22 is located at the deepest region of the inside of the crank drive housing 4 and is therefore always covered by the lubricating oil 23 of the crank housing 4.

In the opening at the bulge 22', arranged symmetrically at the other side of middle plane M with respect to the bulge 22, a filling fitting 24 is threadably connected in order to accomodate renewal of lubricating oil 23. When the crank drive housing 4 is inverted to change the driving position of the crank shaft 5, the pipe fitting 21 and the filling tube 24 will be correspondingly exchanged to accomodate this new position.

At the pressure side of the pump 17, a lubricating oil pressure line 25 is connected which leads via an oil cooler 32 and a connecting line 33 to a collecting or manifold line 34 which branches out to bores in the crank drive housing 4 and/or the crank shaft 5, as well as to special movable parts of the crank drive mechanism 3 to respective lubricating positions. For example, in FIG. 1 there is a lubricating oil channel 26 depicted which extends from below through the crank housing 4 to one of the crank shaft bearings 27. A lubricating oil channel 26′ is also arranged symmetrically with respect to the lubricating oil channel 26 at the other side of the middle plane M, which in the FIG. 1 position is unnecessary and is therefore closed at the housing other side by means of a stopper 28. Upon a changing in the orientation of the crank housing 4 to accomodate, the different driving directions, a corresponding change in the orientation and the connection of bores 26 and 26′ is made.

Excess lubricating oil from the pumping part 17 flows over an opening 29 of the support cover 14 to a space 30 between the cover 14 and the facing end face of the crank shaft 5 so that the driving pinion 19 of the pumping part 17 as well as the toothed ring 20 at the crank shaft are sufficiently lubricated. Through bores 31 in the crank shaft 5 accomodate the flow of the lubricating oil out of the space 30 into the remaining inner spaces of the crank housing 4 and to the lubricating oil filling or reservoir depicted at 23. The lubricating oil pressure line 25 connected with the oil cooler 32 and the connecting lines 33, as especially seen in FIGS. 5 and 6, are arranged as flexible, exchangeable hose lines.

Figures 3, 4, 5, 6:
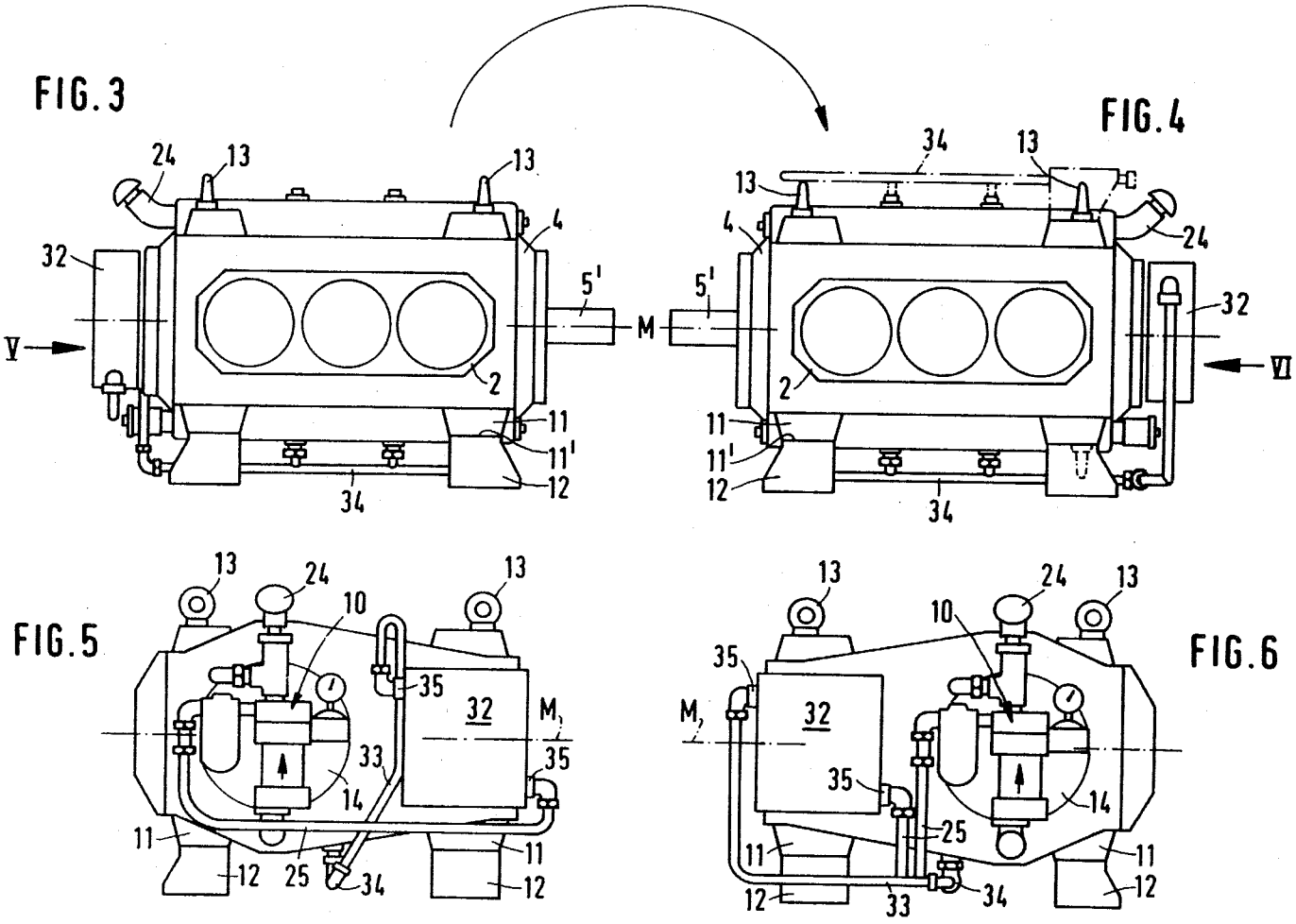
FIG. 3 is a schematic side view of the pump arrangement of the present invention showing the crank drive assembly in a position with a right hand side drive.
FIG. 4 is a side view similar to FIG. 3, showing the arrangement in position for accomodating a left side drive.
FIG. 5 is an axial end view of the crank drive mechanism of the invention taken in the direction of arrow V in FIG. 3.
FIG. 6 is an axial end view of the crank drive mechanism of the invention taken in the direction of arrow VI in FIG. 4.

With the illustrated arrangement it is possible to connect the respective upper oil cooling connection 35 with the collection line 34 and the respective lower cooler connection 35 with the oil pump aggregate 10 independently of the different position of the oil cooler 32 as shown in FIGS. 5 and 6. The oil cooler 32 can therefore be fixedly arranged at the crank drive housing 4. This means that its position relative to the crank housing 4 remains unchanged for the different positions of the crank drive housing 4 illustrated in FIGS. 3 and 5 and FIGS. 4 and 6.

In preferred embodiments, the collection line 34 is assembled independently of crank drive housing 4 at both the upper and lower sides of the crank housing 4 as illustrated in FIG. 4 (dashed-dot lines at top of FIG. 4). However, it is sufficient according to preferred embodiments to provide that the collection line is disposed at only one side of the crank drive housing 4 (this means that the collection line 34 is disposed at only one of the upper or lower halves of the housing 4, with its position changing dependent upon the position of the crank housing 4). According to further preferred embodiments not illustrated, the collection line 34 can be disposed as a bore in the housing 4.

As only schematically depicted in FIG. 1, there is a pipe shaped transparent viewing glass 36 for monitoring the condition of the lubricant filling 23, which glass 36 is disposed to extend the same distance above and below the plane M. Glass 36 communicates with the inside space of the crank housing 4 so that an operator can detect the level of lubricant in the crank housing 4 in both positions thereof, by means of a symmetrical scale arrangement at the sight glass 36.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Piston pump arrangement comprising:

a crank drive housing having a top half and a bottom half relative to a horizontal plane extending through the housing;

a crank drive shaft rotatably supported in said crank drive housing;

a drive coupling connection means at one end face of the crank drive shaft for accommodating a driving connection to a motor or the like to rotatably drive the crank drive shaft; and at least one horizontally disposed pump piston drivingly connected to said crank drive shaft to reciprocate along a pump piston axis which extends substantially perpendicular to the rotational axis of the crank drive shaft;

wherein the top and bottom halves of the crank drive housing are functionally symmetrical so as to allow the crank drive housing to be inverted, and the top half to serve as the bottom half, and vice versa, to convert the piston pump from a right hand drive to a left hand drive.

2. Piston pump arrangement according to claim 1, wnerein a plurality of symmetrically arranged mounting surfaces are provided on said crank drive housing at each side of said horizontal plane.

3. Piston pump arrangement according to claim 1, wherein a plurality of said pump pistons are provided and are drivingly connected with the crank drive shaft by means of crosshead means.

4. Piston pump arrangement according to claim 2, wherein a plurality of said pump pistons are provided and are drivingly connected with the crank drive shaft by means of crosshead means.

5. Piston pump arrangement according to claim 1, wherein fastening point means are disposed in said crank drive housing for accomodating fastening of subassemblies to said crank drive housing, and wherein said fastening point means are arranged symmetrically with respect to the horizontal plane to facilitate conversion of the arrangement between right and left hand end drive.

6. Piston pump arrangement according to claim 5, further comprising a lubricating/cooling pump aggregate being detachably connectible at the symmetrically arranged fastening points at the end of the crank drive housing opposite the drive coupling connection means.

7. Piston pump arrangement according to claim 6, further comprising a pump piston housing means for supporting said at least one pump piston, said pump piston housing means being detachably mounted at the symmetrically arranged fastening points at a lateral side of the crank drive housing.

8. Piston pump arrangement according to claim 5, wherein a lubricating cooling pump aggregate is arranged drivingly connectible with the end face of the crank drive shaft opposite the drive coupling connection means at a support cover which is detachably connectible to the crank drive housing fastening points arranged symmetrically with respect to the horizontal plane.

9. Piston pump arrangement according to claim 8, wherein the support cover is arranged at a flange of the crank drive housing.

10. Piston pump arrangement according to claim 8, wherein a toothed ring is arranged at the facing end of the crank drive shaft adjacent the lubricating/cooling pump aggregate, which toothed ring drivingly engages with a driving trunnion of the lubricating/cooling pump aggregate.

11. Piston pump arrangement according to claims 10, wherein two openings are arranged in the crank drive housing symmetrically to the horizontal plane at the upper and lower most regions of the crank drive housing inside space, said lower opening being connected with the suction side of the lubricating/cooling oil pump aggregate and the upper opening being arranged to accept a detachable pipe piece which serves as a lubricating/cooling oil filling opening.

12. Piston pump arrangement according to claim 11, further comprising an oil cooler connected in series with a lubricating oil pump of the lubricating/cooling oil pump aggregate, wherein the connection lines between the oil pump, the crank drive housing and the cooler are formed as exchangeable similar flexible hoses.

13. Piston pump arrangement according to claim 12, wherein a collection line with several lubricating positions is arranged as a connection between the crank drive housing and the lubricating/cooling pump aggregate.

14. Piston pump arrangements according to claim 1, wherein said crank drive housing includes pedestals arranged symmetrically with respect to the horizontal plane at the upper and lower sides of the crank drive housing.

15. Piston pump arrangement according to claim 1, wherein said crank drive housing is integrally formed with crosshead guide means for slidably guiding crosshead means connected between the at least one pump piston and the crank drive shaft.

16. Piston pump arrangement according to claim 14, wherein said crank drive housing is integrally formed with cross head guide means for slidably guiding crosshead means connected between the at least one pump piston and the crank drives shaft.

17. Piston pump arrangement according to claim 1, further comprising a lubricant viewing sight glass mounted in a wall of said crank drive housing at a position symmetrical to said horizontal plane, whereby the lubricant level in said crank drive housing can be read in both the right and left hand driving positions of the pump arrangement.

* * * * *